US007413182B2

(12) United States Patent
Powell et al.

(10) Patent No.: US 7,413,182 B2
(45) Date of Patent: Aug. 19, 2008

(54) PRINTING SYSTEM AND METHOD

(75) Inventors: Wade A. Powell, Meridian, ID (US); Scott K. Carter, Caldwell, ID (US); Ronald Slutz, Middleton, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 425 days.

(21) Appl. No.: 11/072,126

(22) Filed: Mar. 4, 2005

(65) Prior Publication Data

US 2006/0197274 A1 Sep. 7, 2006

(51) Int. Cl.
*B65H 5/00* (2006.01)

(52) U.S. Cl. ..... 271/10.03; 271/258.01

(58) Field of Classification Search ..... 271/256, 271/258.01, 259, 258.04, 258.03, 265.01, 271/265.02, 264, 10.03
See application file for complete search history.

(56) References Cited

U.S. PATENT DOCUMENTS 4,919,412 A 4/1990 Weigel et al.
5,221,949 A * 6/1993 Miyamoto ..... 399/389
5,345,540 A * 9/1994 Schleifer et al. ..... 700/251
5,575,466 A * 11/1996 Tranquilla ..... 271/10.03
6,186,491 B1 * 2/2001 Tomiyama et al. ..... 271/12
6,279,896 B1 8/2001 Linder et al.
6,318,715 B1 11/2001 Froechte et al.
6,607,194 B2 8/2003 Moeller et al.
6,663,097 B2 12/2003 Bantle

* cited by examiner

*Primary Examiner*—Kaitlin S Joerger

(57) ABSTRACT

A system and method includes a printing system assembly and controller. The printing system assembly is configured to separate media from a printer input during a separation time and then deliver it to a printer marking engine. The controller is configured to measure the separation time. The controller is further configured to adjust a plurality of parameter settings according to the measured separation time and according to the influence each of the parameter settings has on the separation time.

37 Claims, 4 Drawing Sheets

PRINTING SYSTEM AND METHOD

CROSS-REFERENCE TO RELATED APPLICATIONS

This Patent Application is related to U.S. patent application Ser. No. 11/072,045 filed on even date herewith entitled MEDIA STACK MEASUREMENT AND METHOD, commonly assigned to the same assignee as the present invention, and hereby incorporated by reference herein.

BACKGROUND

The present invention relates generally to the field of printing and more particularly to a system and method of an adaptive algorithm for input feeders of printing systems. For many printing systems, media on which printing is to occur is picked from an input feeder. Generally, a mechanism separates a sheet from the top of a stack of media such that it can be fed into a marking engine of a printing system. On occasion there are failures in picking a sheet from a stack of media. Such failure would include a failure to pick the top sheet, a "no-pick," or picking multiple sheets of media at once, a "multi-pick." Both a no-pick and a multi-pick are undesired outcomes. In the case of a multi-pick, this can lead to physical paper jams within the marking engine of a printing system and cause wasted paper, while reducing throughput of the printing system. A no-pick results in no printing.

In order to minimize no-picks and multi-picks and otherwise increase printing performance, printing systems have made use of adjustable settings for the printing system. For example, a printing system has one setting for lightweight media, another setting for heavyweight media and another setting for everything in between. Although such a system can prevent some paper jams, it is not effective for many media types. In addition, such a system fails to adjust for other dynamic changes that occur in the media, such as temperature changes, humidity changes, the overall condition of the media stack, and other changes that vary daily, or even hourly, from print job to print job or from media to media.

For these and other reasons, a need exists for the present invention.

SUMMARY

Exemplary embodiments of the present invention include a system and method for printing on media. The system and method includes a printing system assembly and a controller. The printing system assembly is configured to separate media from a printer input during a separation time and then deliver it to a printer marking engine. The controller is configured to measure the separation time. The controller is further configured to adjust a plurality of parameter settings according to the measured separation time and according to the influence each of the parameter settings has on the separation time.

DETAILED DESCRIPTION

In the following Detailed Description, reference is made to the accompanying drawings, which form a part hereof, and in which is shown by way of illustration specific embodiments in which the invention can be practiced. It is to be understood that other embodiments can be utilized and structural or logical changes can be made without departing from the scope of the present invention. The following Detailed Description, therefore, is not to be taken in a limiting sense, and the scope of the present invention is defined by the appended claims.

Figure 1:
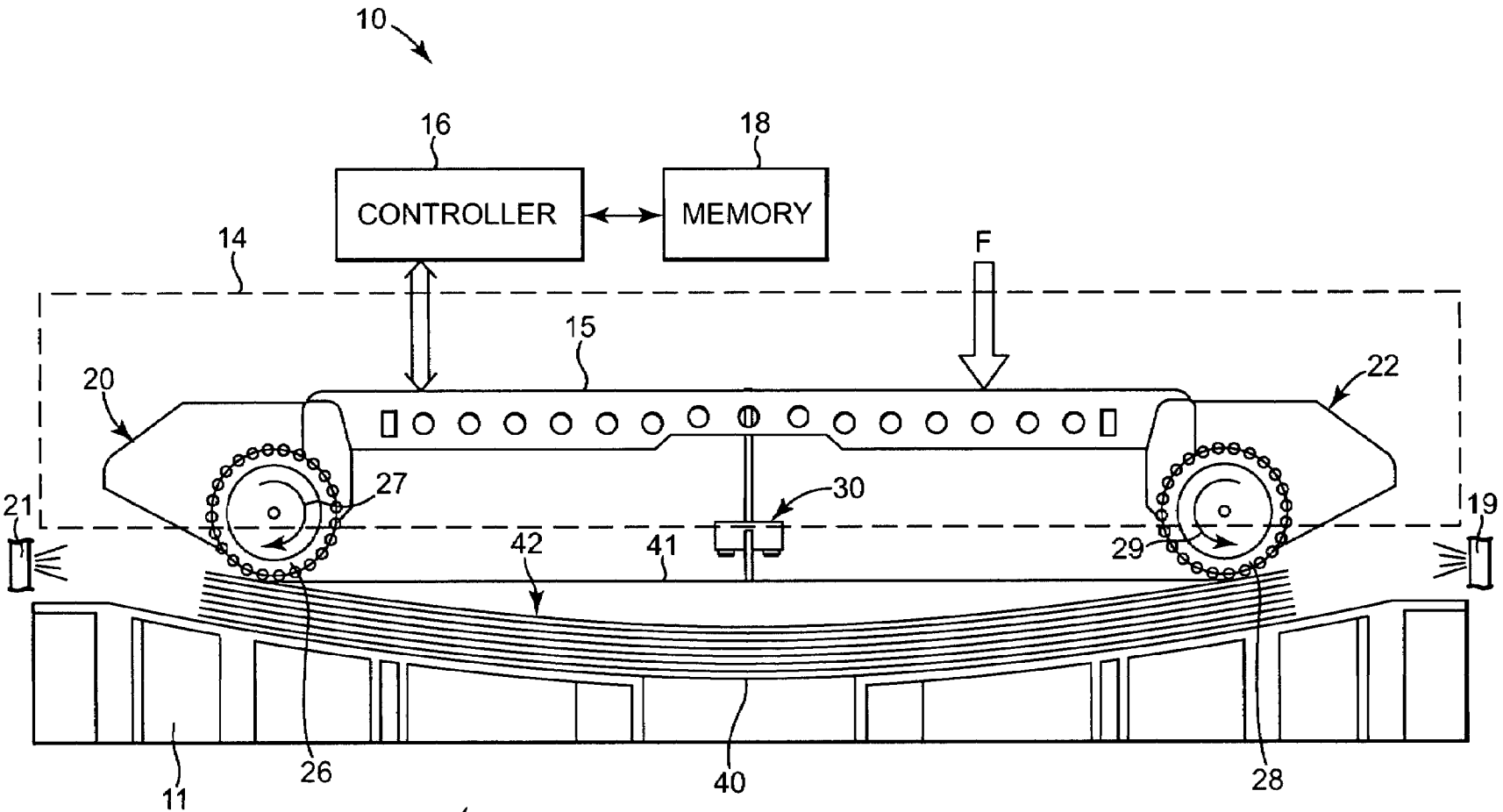
FIG. 1 illustrates a media pick system that is part of a printing system according to one embodiment of the present invention.

FIG. 1 illustrates a portion of printing system 10 in accordance with one embodiment of the present invention. Printing system 10 includes input feeder 12, feedhead assembly 14, controller 16, and memory 18. Feedhead assembly 14 further includes first roller assembly 20 and second roller assembly 22, which are coupled to assembly bar 15. First tractor roller 26 is mounted within first roller assembly 20 and second tractor roller 28 is mounted within second roller assembly 22. Media sensor 30 is also mounted on feedhead assembly 14. Input feeder 12 includes a media tray 11 with a concave surface 40 that is configured to hold media 42, including top sheet 41. Blowers 19 and 21 are configured to blow air into media 42.

In one embodiment, feedhead assembly 14 of printing system 10 is configured to separate a sheet from a stack of media 42 and deliver it to a marking engine within printing system 10. Separating a sheet from a stack of media 42 in input feeder 12 and delivering the sheet to a marking engine of printing system 10 is referred to as a "pick". The amount of time that it takes to separate a sheet from a stack of media 42 making it ready to be delivered to the printer marking engine is referred to as the "pick time" or the "separation time."

Figure 2:
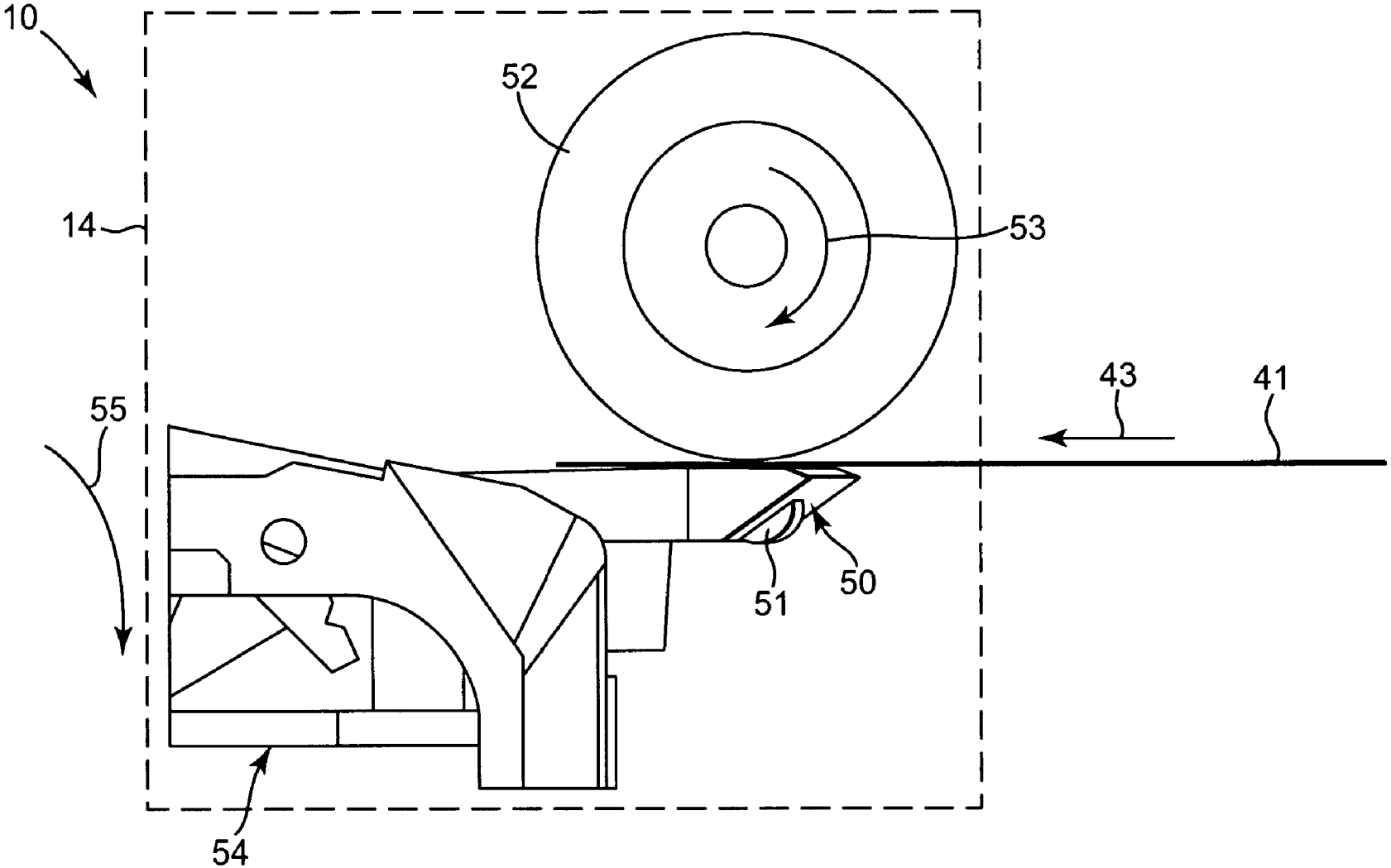
FIG. 2 illustrates a portion of the media pick system illustrated in FIG. 1.

FIG. 2 illustrates an additional portion of printing system 10 in accordance with one embodiment of the present invention. FIG. 2 illustrates a cross-sectional view of a portion of printing system 10 that is taken perpendicular to that illustrated in FIG. 1. FIG. 2 illustrates carriage wedge 50, nip roller 51, exit roller 52, and exit assembly 54, which are also configured on feedhead assembly 14. (For ease of illustration, carriage wedge 50, nip roller 51, exit roller 52, and exit assembly 54 are not illustrated in FIG. 1). Carriage wedge 50 and nip roller 51 operate in conjunction with those portions of feedhead assembly 14 illustrated in FIG. 1 to remove sheets of media 42 from input feeder 12 and deliver the sheets of media 42 to the marking engine of printing system 10.

In operation of one embodiment of the present invention, feedhead assembly 14 picks a sheet from a stack of media 42 in input feeder 12 by first utilizing first and second tractor rollers 26 and 28. First and second tractor rollers 26 and 28 press down with a force F and rotate in the direction of the arrows 27 and 29, respectively (as indicated in FIG. 1). In one embodiment, first and second rollers 26 and 28 are further provided with a plurality of smaller rollers or bearings on their outer periphery. In this way, rotation of first and second tractor rollers 26 and 28 while pressing down in this way engages the top sheet 41 of a stack of media 42 that is placed in media tray 11. Since media tray 11 has concave surface 40, the media 42 that is placed there also has a concave bend that follows concave surface 40. As first and second tractor rollers 26 and 28 rotate as indicated and engage the top sheet 41 of media 42, they pull the edges outward thereby pulling the center of media 42 away from concave surface 40 and upward toward media sensor 30. Thus, the top sheet 41 of media 42 is moved from a relatively concave position to a more taut and planar position.

Once media 42 has reached a relatively planar position it impacts media sensor 30. As a top sheet 41 of the stack of media 42 moves up to impact media sensor 30, several sheets of media in a section just below the top sheet 41 toward the top of the stack of media 42 are all being lifted at varying rates. The top sheet 41 rises faster than the second sheet, which rises faster than the third sheet, and so on. After the top sheet 41 becomes flat and taut, and tractor rollers 26 and 28 are allowed to continue running for a period of time after the top sheet 41 is flat (also referred to as "overrun time"), the next lower sheets below the top sheet 41 begin to lower back down toward concave surface 40. Thus, the sheets just below the top sheet 41 of media 42 separate further from the top sheet 41 providing space between the top and the next lower sheet.

Once the top sheet 41 of the stack of media 42 impacts media sensor 30 and sufficient space is established between the top and the next sheet (due to its falling back), carriage wedge 50 deploys under the top sheet 41 of media 42(illustrated in FIG. 2). Then, exit roller 52 rotates in the direction indicated by arrow 43 thereby pinching media 53 between exit roller 52 and nip roller 51 and moving it out of input feeder 12 in the direction indicated by arrow 43. In one embodiment, media 42 is sent to exit assembly 54, which is coupled to the marking engine of printing system 10. Also in one embodiment, the direction indicated by arrow 43 in FIG. 2 is perpendicular to the plane of the cross-section illustrated in FIG. 1.

A multitude of parameters within printing system 10 affect the separation time, that is, the amount of time that it takes to move the top sheet 41 of media 42 from the concave shape 40 of media tray 11 to a taut and planer position. In addition, many of these same parameters also affect the occurrence of a "no-pick," where no media 42 is separated from input feeder 12. Furthermore, many of these parameters also affect the occurrence of a "multi-pick," where multiple sheets of media 42 are removed from input feeder 12 at once. In one embodiment, such parameters affecting separation time, no-pick events and multi-pick events include the downward force (F) on first and second tractor rollers 26 and 28, carriage angle of carriage wedge 50, air time of air blowing from blowers 19 and 21 into media 42, and overrun time of first and second tractor rollers 26 and 28.

Each of these parameters can affect the time it takes to separate sheets of media 42 from input feeder 12 and can influence the occurrence of a no-pick or multi-pick. The "down force" parameter refers to the amount of normal force F applied on feedhead assembly 14, which pushes first and second tractor rollers 26 and 28 against media 42. As the down force increases, more media 42 tends to rise up faster toward media sensor 30. An increase in the down force tends to decrease the separation time. The converse is also true such that a decrease in the down force tends to increase the separation time. If the down force is too great there is an increased risk of a multi-pick because more media will have risen up toward media sensor 30. Conversely, if the down force is too low in one case, media 42 is not sufficiently drawn upward toward paper sensor 30 in a timely manner. This increases the separation time and increases the risk of a no-pick.

The "carriage angle" parameter refers to the downward angle at which carriage wedge 50 is inserted relative to the top sheet 41 of media 42. In FIG. 2, the entire exit assembly 54, including carriage wedge 50, can be tilted downward in the direction indicated by arrow 55. This downward angle is the carriage angle. For example, if carriage wedge 50 is parallel to the top sheet 41 of media 42 when media 42 is plainer and taut, then the carriage angle is referred to as 0, or 0 degrees relative to planar. As the carriage wedge 50 is angled down relative to the planer top sheet 41 of media 42 (in the direction of arrow 55), the carriage angle increases. As the carriage angle increases, the separation time tends to get shorter. Again, the converse is also true such that a decrease in the carriage angle tends to increase the separation time. If the carriage angle is increased too much, however, then when carriage wedge 50 is inserted under media 42 there is a risk that carriage wedge 50 will actually deploy too low, and thus below multiple sheets of media thereby causing a multi-pick. Conversely, if the carriage angle is not increased enough, then in one case media 42 is not lifted high enough (or taut enough) to trigger sensor 30, thereby causing a no-pick.

The "air time" parameter is the amount of time that air is blown into media 42. Typically, blowers 19 and 21 are located adjacent the sides of the stack of media 42 and blown in on its sides. In one embodiment, air is blown in on all four sides of a rectangular stack of media 42. As the air time increases, the separation time tends to get shorter. Again, the converse is also true such that a decrease in the air time tends to increase the separation time. If the air time is set too high and too much air is blown, there will not be enough friction causing too many sheets of media 42 to rise up thereby increasing the risk of a multi-pick. Conversely, if the air time is too low thereby not allowing enough air to blow into the stack of media 42, the sheets of media 42 will have too much friction thereby preventing feedhead assembly 14 in FIG. 1 from feeding sheets, which causes a no-pick.

Finally, the "overrun time" parameter is the amount of time that first and second tractor rollers 26 and 28 are allowed to continue to rotate after the top sheet 41 of media 42 has become flat and taut during an attempt to pick a single piece of media 42. As explained previously, as first and second tractor rollers 26 and 28 rotate, media 42 is drawn upward toward the paper sensor 30. After media 42 impacts media sensor 30 and first and second tractor rollers 26 and 28 are allowed to continue to rotate, the media below the top sheets of media 42 will begin to fall back toward concave surface 40. The longer that first and second tractor rollers 26 and 28 are allowed to run before carriage wedge 50 is deployed under the top sheets of media 42 the further the remaining sheets will fall back toward concave surface 40. In this way, the overrun time parameter does not typically influence a no-pick, but does affect the occurrence of a multi-pick, that is, if only a short overrun time is allowed, the risk of a multi-pick increases.

Most printing systems 10 have a practical limit on the amount of time that is allowed for picking a sheet of media 42. This is because most printing systems will have a desired throughput, such that a set amount of sheets of media are processed in a given cycle time period. The "cycle time" in printing system 10 refers to the amount of time from a first attempt to begin to pick one sheet of media 42 to the time the next sheet is attempted to be picked. The cycle time is the product of the separation time, the eject time, the overrun time and some margin time. As discussed previously, the separation time is the amount of time that it takes to separate a sheet from a stack of media 42 and make it ready to be delivered to the printer marking engine and the overrun time is the amount of time that the tractor rollers are allowed to continue to rotate after the top sheet 41 of media 42 has become flat and taut, that is, separated from the stack of media 42. The eject time is the amount of time that it takes for a sheet that has been separated to then be delivered to the printer marking engine. Margin time can be a flexible amount of time to adjust each cycle.

Thus, in many instances the overrun time is set to the maximum amount of cycle time that printing system 10 will allow for picking a single sheet of media 42, minus the separation time, eject time and any margin time. Consequently, in one embodiment of the present invention, the overrun time is set to this maximum.

In addition to the four parameters described above, there are other parameters in a printing system that affect the separation time, especially in printing systems that have differently configured input feeders and feedhead assemblies. For example, the actual curvature of the stack of media 42 can affect the separation time. Commonly-assigned U.S. patent application Ser. No. 11/072,045 filed on even date herewith entitled MEDIA STACK MEASUREMENT AND METHOD describes a system and method for measuring this curvature. Such a measurement can also be used to make adjustments to the separation time in accordance with the present embodiment. The adaptive algorithm in printing system 10 of the present embodiment, however, will be described using three exemplary parameters. One skilled in the art will recognize that other, additional, or substitute parameters can be used to optimize separation time and system performance.

In one embodiment of printing system 10, a sheet from the top of a stack of media is separated from input feeder 12 and is fed into the marking engine under the control of controller 16. Controller 16 then measures the separation time and compares that measured separation time to an optimum separation time that is stored in memory 18. An optimum separation time can be based on the media type being processed in printing system 10. For example, media with different weights, thickness, and/or other characteristics will have different optimum separation times. Controller 16 then determines whether any of the above-described parameters need to be changed, based on the comparison, in order to ensure that the measured separation time is close to the optimum separation time. In one embodiment, parameters are changed in an orderly and flexible fashion such that the separation time is controlled. In addition, multi-picks, no-picks, and other jams are minimized by operation of controller 16.

Figure 3:
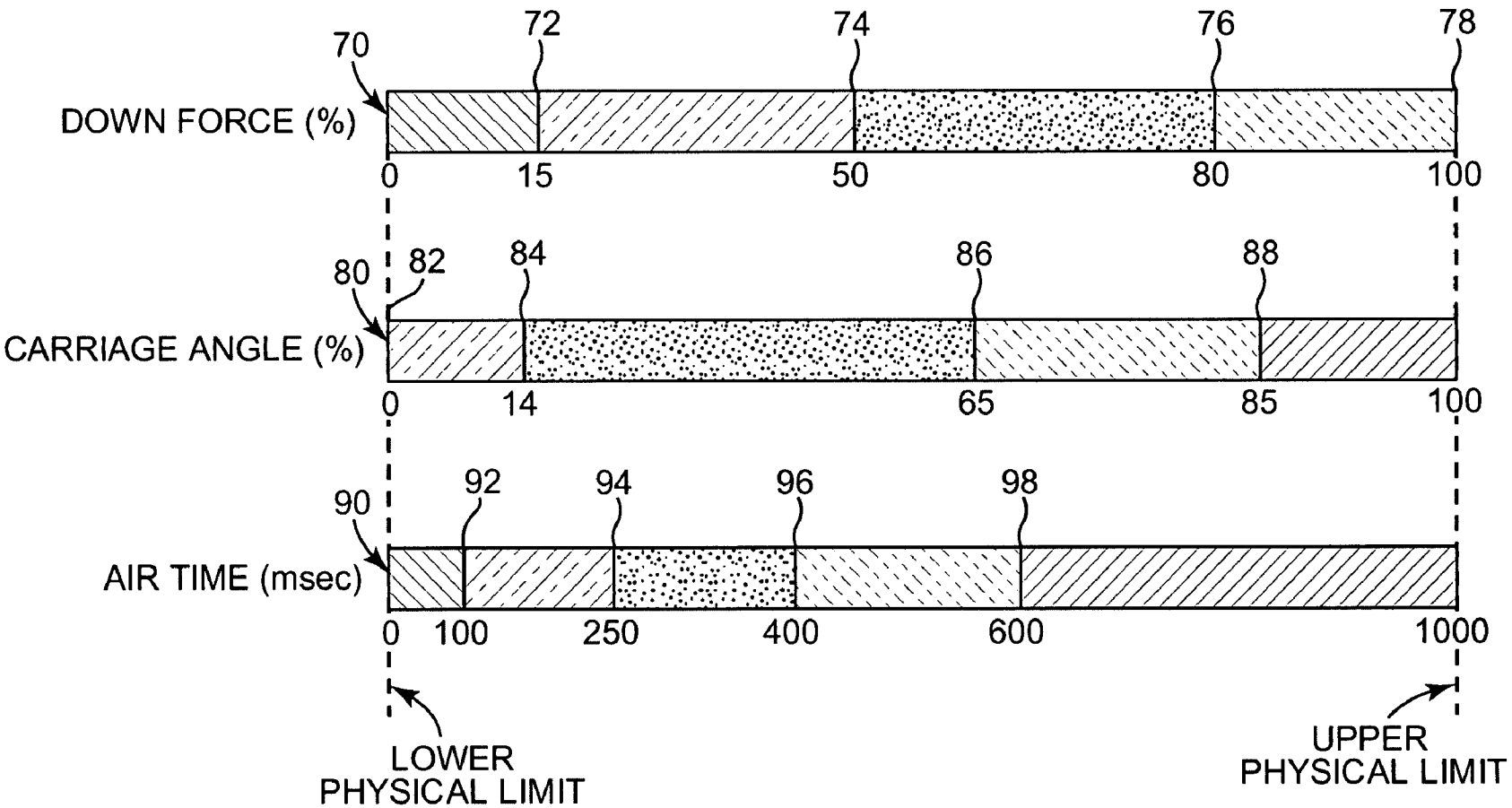
FIG. 3 is a graphical illustration of parameters used in accordance with one embodiment of the present invention.

FIG. 3 illustrates parameter ranges for three of the previously described parameters. Down force range 70, carriage angle range 80, and air time range 90 are each illustrated. Each parameter range has an upper and lower physical limit and can be adjusted between these limits to maximize printer performance in accordance with one embodiment of the present invention. By measuring the separation time and comparing the measured separation time with an optimum separation time, one embodiment of printing system 10 then adjusts one or more of these parameters within the given ranges in order to optimize the separation time.

In one embodiment, down force range 70 has a physical lower limit representing no force F being applied to feedhead assembly 14 and an upper physical limit representing a maximum amount, or 100 percent of force F that can be applied to feedhead assembly 14 within printing system 10. In one case, this represents the maximum amount of force that a motor can produce.

In accordance with one embodiment of the invention, down force range 70 is then further divided into four sub-ranges: out of range, between the lower physical limit and an absolute lower limit 72; a lower sub-range, between absolute lower limit 72 and a preliminary lower limit 74; a preliminary sub-range, between the preliminary lower limit 74 and a preliminary upper limit 76; and an upper sub-range, between preliminary upper limit 76 and absolute upper limit 78. In one embodiment, absolute upper limit 78 is also the physical upper limit for down force range 70. In one embodiment, the lower physical limit correlates to 0 percent of the force F; absolute lower limit 72 correlates to 15 percent of the force F; preliminary lower limit 74 correlates to 50 percent of the force F; preliminary upper limit 76 correlates to 80 percent of the force F; and absolute upper limit 78 correlates to 100 percent of the force F.

In one embodiment, carriage angle range 80 has a physical lower limit representing a 0 degree angle of carriage wedge 50 relative to a taut and planer top sheet 41 of media 42 and an upper physical limit representing a maximum, or 100 percent, angle that can be used for carriage wedge 50 relative to a taut and planer top sheet 41 of media 42 within printing system 10. In one case, this maximum angle where carriage wedge 50 is tipped down 5 degrees relative to a taut and planer top sheet 41 of media 42.

In accordance with one embodiment of the invention, carriage angle range 80 is also further divided into four sub-ranges: a lower sub-range, between absolute lower limit 82 and a preliminary lower limit 84; a preliminary sub-range, between the preliminary lower limit 84 and a preliminary upper limit 86; an upper sub-range, between preliminary upper limit 86 and absolute upper limit 88; and out of range, between the absolute upper limit 88 and the upper physical limit. In one embodiment, absolute lower limit 82 is also the physical lower limit for carriage angle range 80. In one embodiment, the lower physical limit correlates to 0 percent of the maximum angle of exit assembly 54 relative to a planer media 42; preliminary lower limit 84 correlates to 14 percent of the maximum angle; preliminary upper limit 86 correlates to 65 percent of the maximum angle; absolute upper limit 88 correlates to 85 percent of the maximum angle; and the upper physical limit correlates to 100 percent of the maximum angle.

In one embodiment, air time range 90 has a physical lower limit representing air being blown in the stack of media for 0 milliseconds and an upper physical limit representing air being blown in the stack of media for 1,000 milliseconds in printing system 10.

In accordance with one embodiment of the invention, air time range 90 is also further divided into four sub-ranges: a lower sub-range, between absolute lower limit 92 and a preliminary lower limit 94; a preliminary sub-range, between the preliminary lower limit 94 and a preliminary upper limit 96; an upper sub-range, between preliminary upper limit 96 and absolute upper limit 98; and out of range, both between the absolute upper limit 98 and the upper physical limit as well as between the lower physical limit and absolute lower limit 92. In one embodiment, the lower physical limit correlates to no air being blown in the stack of media 42; absolute lower limit 92 correlates to air being blown in the stack of media 42 for 100 milliseconds; preliminary lower limit 94 correlates to air being blown in the stack of media 42 for 250 milliseconds; preliminary upper limit 96 correlates to air being blown in the stack of media 42 for 400 milliseconds; absolute upper limit 98 correlates to air being blown in the stack of media 42 for 600 milliseconds; and the upper physical limit correlates to air being blown in the stack of media 42 for 1,000 milliseconds.

In operation of one embodiment of the invention, each of the parameters are set to an initial parameter setting and associated with an optimum separation time, which are all held in memory 18. Since some sheets of media 42 need less time to separate and some sheets need more, different initial parameter settings and associated optimum separation times are uniquely associated with different types of media 42 in one embodiment. Typically, heavy and thick sheets take longer to separate than light and thin sheets. In one embodiment, for many different weights of media, testing is performed to determine an optimum separation time for that weight of media, as well as the associated initial parameter settings.

In one embodiment of the present invention, printing system 10 attempts to pick or separate a first page of media 42. If the pick is successful, a separation time is measured. If the measured separation time is equal to the optimum separation time, plus or minus a predetermined tolerance, all of the parameter settings are left unchanged. If the measured separation time is less than the allowable time, indicating a high probability of a multi-pick, one of the three parameter settings (within the ranges illustrated in FIG. 3) is reduced. If the time is too long, however, then one of the parameter settings is increased. The pick process is then resumed. In one embodiment, the specific parameter setting that is changed, and the amount by which it is changed, is custom adjusted according to various system conditions.

In one case, initial parameter settings are established for down force 70 in the preliminary sub-range between preliminary lower limit 74 and preliminary upper limit 76, for carriage angle range 80 in the preliminary sub-range between preliminary lower limit 84 and preliminary upper limit 86, and for air time 90 in the preliminary sub-range between preliminary lower limit 94 and preliminary upper limit 96. These initial parameter settings are chosen for each media type and associated with an optimum separation time. A tolerance is then allowed for each optimum separation time associated with the initial parameter settings. Thus, if the measured separation time is within the tolerance for the optimum separation time, no parameter setting adjustments are needed. If the measured separation time is outside the tolerance for the optimum separation time, parameter setting adjustments are needed, as will be described in more detail below.

As illustrated in FIG. 3, each of the given parameter ranges 70, 80, and 90 have a preliminary sub-range between the preliminary lower limits 74, 84, and 94 and the preliminary upper limits 76, 86, and 96. One embodiment of the present invention, printing system 10 has its maximum performance when each of the system parameters has initial parameter settings in the preliminary sub-range. Thus, one embodiment of the present invention, based on the type of media being processed, controller 16 saves an optimum separation time and associated initial parameter settings in memory 18. Controller 16 then measures the separation time of a top sheet 41 of media 42 from the remaining stack and compares that measurement to the optimum separation time to determine if initial parameter settings need to be changed in order to maximize system performance. When parameters settings are needed, they are changed in an orderly and flexible fashion such that the separation time is controlled.

In one embodiment, when adjustments to parameters settings are needed, each of the parameter settings are first adjusted within a single sub-range for the given parameter range. For example, in one case each of the parameter settings are first adjusted within the preliminary sub-range of their given parameter range before any parameter is adjusted outside the preliminary sub-range. Thus, where a shorter separation time is needed (that is, where the optimum separation time plus the tolerance is shorter than the measured separation time), the down force parameter setting is first increased within its preliminary sub-range until the preliminary upper limit 76 is reached. Then, if a shorted separation time is still needed (that is, where the optimum separation time plus the tolerance is still shorter than the measured separation time when subsequent sheets of media are separated), the carriage angle parameter is then increased within its preliminary sub-range until the preliminary upper limit 86 is reached. Finally, if a shorted separation time is still needed (that is, where the optimum separation time plus the tolerance is still shorter than the measured separation time when subsequent sheets of media are separated), the air time parameter is then increased within its preliminary sub-range until the preliminary upper limit 96 is reached.

As is apparent from the above example, on average, separation time decreases when the down force increases, the carriage angle increases, and/or the air time increases. Conversely, separation time increases when the down force decreases, the carriage angle decreases, and/or the air time decreases.

In one embodiment of the invention, when a no-pick or a multi-pick occurs additional adjustments to those described above are made. For example, in one case when a no-pick or a multi-pick occurs, this indicates that the optimum separation time that is stored for that media type is not accurate. Consequently, the optimum separation time is adjusted. In addition to adjusting the optimum separation time, in one embodiment adjustments to the parameters are made more quickly than compared to adjustments made in the absence of multi-picks and no-picks.

Figure 4:
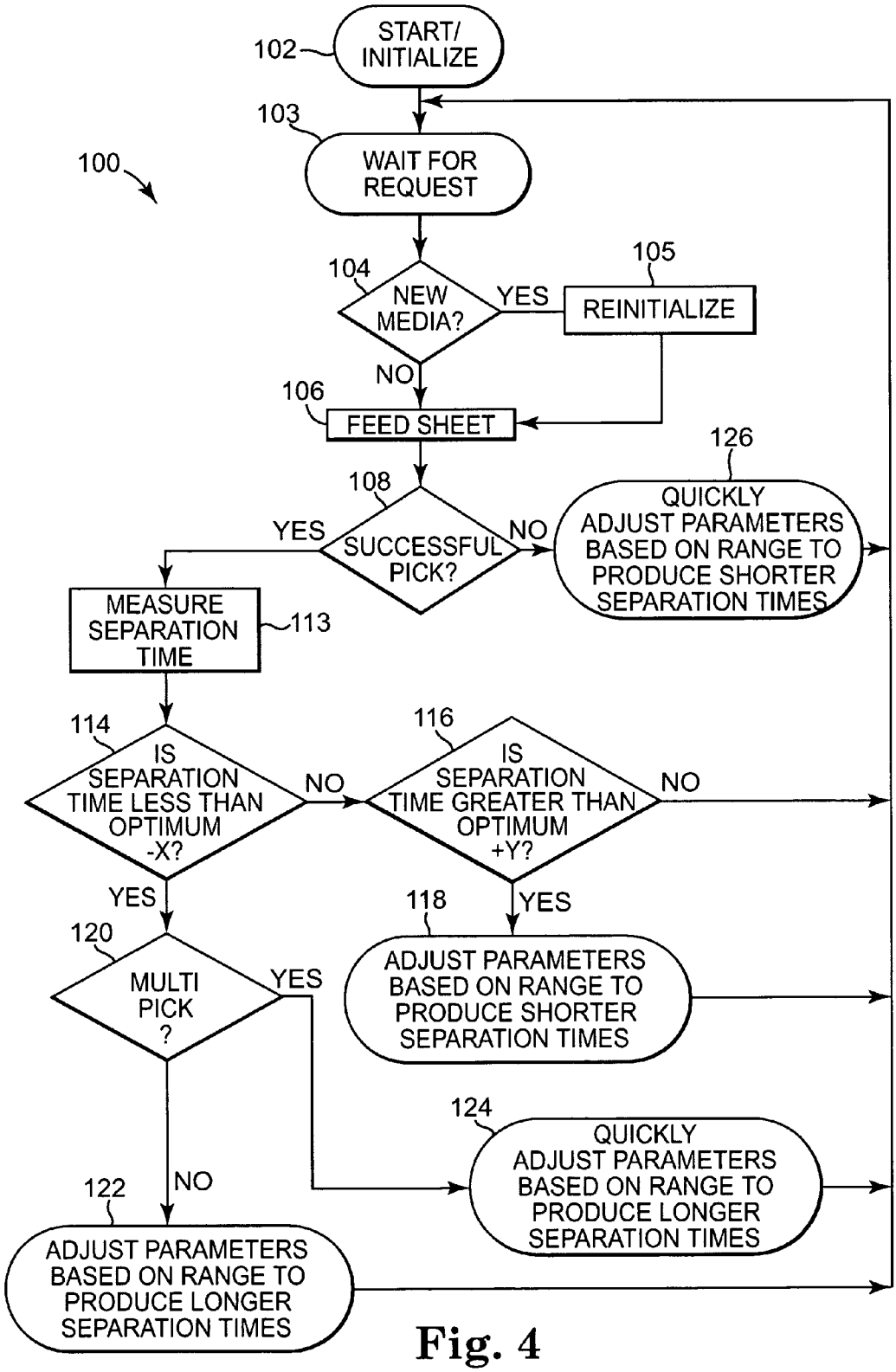
FIG. 4 is a flow diagram illustrating one embodiment of an adjustment algorithm according to one embodiment of the present invention.

FIG. 4 is a flow diagram illustrating one embodiment of a printing system in accordance with the present invention. In the illustrated embodiment, an adaptive algorithm is utilized by controller 16 to minimize multi-picks and no-picks while being able to pick and deliver sheets of media 42 at the desired sheet throughput rate for printing system 10.

The process is initialized at 102. As part of initialization, determinations are typically made about the media 42 being processed in the print job. In one embodiment, printing system 10 prompts the user to input information about the media 42 being processed. In another embodiment, a printing system 10 runs tests on media 42 that is loaded into input tray 11 in order to determine its characteristics. One such way is to measure its thickness. In either event, initial parameters are set and stored in memory 18 for the particular media 42 being processed in printing system 10. From these initial parameters and media characteristics, the optimum separation time is also calculated and stored, as is a plus and minus tolerance for the optimum separation time. Preliminary upper 76, 86, and 96 and lower 74, 84, and 94 limits are also established and stored for each of the parameter ranges, as are absolute upper 78, 88, and 98 and lower 72, 82, and 92 limits. In one embodiment, all of this is stored in a look-up table that is adjustable and programmable.

Printing system then waits for a request to begin the media pick process at 103. When such a request is received, a determination is made as to whether or not there is new media in media tray 11 at 104. If there is new media 42, then the system reinitializes at 105 and then feeds a sheet of media 42 at 106. If there is not new media 42, then the system feeds a sheet of media 42 at 106. Next, a determination is made as to whether there was a successful pick of sheet of media 42 at 108. If the sheet of media 42 was successfully picked and separated from input feeder 12 to the marking engine, then the separation time for the sheet of media 42 is measured at 113.

At 114, a comparison is made between the measured separation time and the optimum separation time that was stored in memory 18 for the particular media 42 being processed in printing system 10. At 114 a determination is then made as to whether the measured separation time is less then the optimum separation time minus a tolerance X. In one case, the tolerance is adjusted and programmable depending on how closely the measured separation time is sought to follow the optimum separation time for a given printing system 10.

If the measured separation time is not less then the optimum separation time minus tolerance X, then a determination is made as to whether the measured separation time is greater then the optimum separation time plus a tolerance Y at 116. In one case, the amount of time used for tolerance X is equal to that used for tolerance X. In other cases, they are different.

If the measured separation time is not greater then the optimum separation time plus the tolerance Y then the system cycles back to wait for another request at 103. In this way, if the measured separation time is within the tolerances X and Y of the optimum separation time, then no adjustments are made so the parameter settings and the printing job continues by feeding another sheet of media 42 at 106 after a request is received at 103.

If it is determined at 116 that the measured separation time is greater than the optimum separation time plus tolerance Y, however, then parameter settings are adjusted based on the current sub-range of the parameters in order to produce shorter separation times at 118. When the measured separation time is greater than the optimum separation time plus tolerance Y, the separation time for that fed sheet of media 42 is too long. In this way, printing system 10 makes adjustments to the parameter settings in order to decrease the separation time into an acceptable range.

In one embodiment of the present invention, adjustment to the down force parameter setting has the greatest affect on separation time. Thus, in one embodiment of the invention adjustments to the parameter settings at 118 include first adjusting the down force parameter setting before other parameters settings are adjusted. In one case, adjustment to the carriage angle parameter setting has the next most significant affect on separation time, and is consequently adjusted after adjustments to the down force parameter setting. Finally, adjustments to the air time parameter setting has the next most significant affect on separation time and are consequently adjusted next.

As previously indicated, initial parameter settings are made within each of the parameter ranges 70, 80, and 90. In one embodiment, adjustments are made to parameter settings at 118 in accordance with which sub-range a parameter setting is located. For example, in one embodiment, parameter settings for each of the parameters start in the preliminary sub-range. Specifically, initial parameter settings for down force are between preliminary lower limit 74 and preliminary upper limits 76. Similarly, initial parameter settings for carriage angle are between preliminary lower limit 84 and preliminary upper limit 86. Similarly, initial parameters settings for air time are between preliminary lower limit 94 and preliminary upper limit 96. When separation time needs to be shortened at 118, adjustment is first made to the down force parameter setting within the preliminary sub-range.

In one embodiment, the preliminary sub-range of the down force setting is further divided into predefined increments. Thus, when adjustment is made at 118, the down force parameter can be increased within the preliminary sub-range by one predefined increment. Next, the system cycles back to wait for another request at 103, and when received, feed another sheet at 106. If a shorter separation time is still needed at 118, the down force parameter setting is again increased within the preliminary sub-range by one additional increment. This process can be repeated until preliminary upper limit 76 is reached in down force range 70. Once preliminary upper limit 76 is reached, then the carriage angle initial setting is increased to produce shorter separation times as needed. Again, predefined increments can be established for adjusting the carriage angle parameter setting within its preliminary sub-range. Similarly, once preliminary upper limit 86 is reached, then the carriage angle is no longer increased and the air time parameter setting will be adjusted within its preliminary sub-range by predefined increments until preliminary upper limit 96 is reached.

Once preliminary upper limit 96 is reached, each of preliminary upper limits 76, 86 and 96 will have been reached. If a shortened separation time is still needed, one embodiment of printing system 10 will then adjust each of the parameter settings to the maximum. In this way, the down force parameter setting is adjusted to absolute upper limit 78, carriage angle parameter setting is adjusted to absolute upper limit 88, and air time parameter setting is adjusted to absolute upper limit 98. In one case, multiple pick attempts are allowed at these maximum adjusted settings, and if the measured separation time is still not within tolerance X and Y of the optimum separation time, printing system 10 in one embodiment declares a failure to the user.

If the comparison at 114 indicates that the measured separation time is less then the optimum separation time minus tolerance X then a determination is made at 120 as to whether a multi-pick has occurred. One embodiment of printing system 10 tracks the number of multi-picks and no-picks that have occurred in the processing of media 42. If a multi-pick has not occurred, then parameter settings are adjusted at 122 in order to produce longer separation times.

In one embodiment, the process for adjusting parameters at 122 is based on a similar mechanism as described with respect to the adjustments made at 118. For example, in one embodiment, parameter settings for each of the parameters start in the preliminary sub-range. In one case, the down force parameter setting is first decreased in predefined increments within its preliminary sub-range to produce longer separation times until the preliminary lower limit 72 is reached. Similarly, the carriage angle parameter setting is next decreased in predefined increments within its preliminary sub-range to produce longer separation times until the preliminary lower limit 82 is reached. And finally, the air time parameter setting is decreased in predefined increments within its preliminary sub-range to produce longer separation times until the preliminary lower limit 92 is reached.

If a multi-pick has occurred at 120, one embodiment of the invention will adjust the optimum separation time and then adjust parameter settings more quickly than in the case where no multi-picks have occurred. Thus, instead of adjusting by single predefined increments at a time as described above, once a multi-pick has occurred adjustments are made by four predefined increments, for example. In this way, parameter settings are quickly adjusted at 124 in order to produce longer separation times. In one embodiment, where more than one multi-pick occurs on two consecutive media sheets the parameters settings will be adjusted by larger amounts thereby speeding up the correction process of the separation time. For example, the predefined increments within the sub-regions described above used to adjust parameter settings at 118 and 122 can be doubled, tripled, or quadrupled and then this multiple of the increment is used in making adjustments to parameter settings at 124. In one case, the predefined increments used to adjust parameter settings at 118 and 122 are multiplied by the number of multi-picks that printing system 10 has monitored and stored, and the resulting increased increment is then used to adjust parameters at 124 as needed to produce longer separation times.

Similar to the adjustments made at 124, the occurrence of no-picks will cause the quick adjustments to parameter settings at 126 as well as adjustments to the optimum separation time. If the determination of an unsuccessful pick occurs at 108, printing system 10 will adjust parameter settings by relatively large amounts at 126. In one embodiment, a technique similar to that used in 124 is employed. In this way, the predefined increments used to adjust parameter settings at 118 and 122 are multiplied by the number of no-picks that printing system 10 has monitored and stored, and the resulting increased increment is then used to adjust parameters at 126 as needed to produce shorter separation times. Once the absolute upper limits 78, 88, and 98 are reached and no-picks are still occurring, printing system 10 will declare a failure to the user.

In one embodiment of printing system 10, the first sheet of media 42 that is processed for a printing job is essentially ignored. In some instances, the behavior of the first sheet of media 42 is not consistent with the remaining sheets. Since first and second rollers 26 and 28 have not previously pushed on media 42, air has not previously blown into the stack of media 42 and the media 42 has not generally been manipulated by feedhead assembly 14, the first sheet of media 42 can behave somewhat uniquely relative to the remaining sheets. In this way, one embodiment of the invention simply ignores the first sheet of media by not measuring, or at least not using, the separation time for the first sheet, thereby making no parameter setting adjustments based on the first sheet.

In another embodiment, the stack of media 42 is preconditioned before processing by printing system 10 begins. For example, in one case first and second rollers 26 and 28 engage media 42 for a set amount of time and begin rotating thereby separating the sheets from concave surface 40. Then, rollers 26 and 28 are turned off and air is blown into the stack of media 42 for another set amount of time. Then, feedhead assembly 14 is retracted from media 42 and then returned back to media 42. This process can be repeated several times to precondition the media such that all sheets of media 42, including the first sheet to be processed, will generally behave similarly.

In another embodiment of the invention, printing system 10 includes a learning mode. With learning mode, rather than having memory 18 preset to hold parameter settings, upper, lower and preliminary range values, and optimum separation times for various media types, printing system 10 tests media 42 that is placed in input feeder 12 to determine what settings should be saved into memory 18. Controller 16 begins with certain assumptions, but then changes parameter settings and times based on testing of the media 42.

In one embodiment, during the learning mode, printing system 10 is allowed to make some mistakes on purpose so it determines what limits should be. In this way, it can test for and store upper and lower range and sub-range limits for the various system parameters. For example, in a learning mode, printing system 10 can test very high and very low down forces in different combinations. It then runs multiple sheets of media 42 at these various settings and update what looks to be the optimum separation time, and build a look-up table for various parameter settings and separation times.

Printing system 10 enables picking of a wide spectrum of media weights, media thickness, and media having significantly varied characteristics. It further enables picking media in different environmental conditions, and even where conditions change from printing job to printing job, or even changes during a printing job. Printing system 10 includes a variety of input feeders and includes a broad spectrum of media 42, including paper of widely differing thickness and a wide variety of plastics and transparencies. The adaptive algorithm used by controller 16 is extremely flexible in its design and can be easily customized for any special type of media 42.

Printing system 10 is a flexible and dynamic system that is adaptable to a variety of printing jobs. In one embodiment, by defining three parameters ranges that affect printing performance, and then dividing each of the parameter ranges into three sub-ranges, printing system 10 allows system adjustment within nine different ranges. Accounting for the fact that adjustments can be moved up or down, eighteen different adjustments can potentially be made to increase system performance. One skilled in the art will see that when additional parameters are used, and ranges and sub-ranges defined, even more adjustment is possible.

Furthermore, adjustment within printing system 10 can be simplified in printing jobs that are relatively simple. For example, where the air time parameter really does not affect separation time for a given print job, printing system 10 can simply set the air time parameter setting to always be lower preliminary limit 94. In this way, this parameter setting will no longer be adjustable, and is locked at 250 milliseconds each time the system cycled through its adjustment algorithm, and will make adjustments to the other parameters instead.

Similarly, the system can be simplified by eliminating sub-ranges, for example by making the upper and lower limit of a sub-range the same number. The ranges and sub-ranges can be opened up, shrunk down, or eliminated altogether. Where ranges, sub-ranges and other settings are stored in a look-up table within memory 18, such changes are straight forward and easily programmable. Custom tables can be established for certain media, and tables can be associated with a custom mode for certain media.

Although specific embodiments have been illustrated and described herein, it will be appreciated by those of ordinary skill in the art that a variety of alternate and/or equivalent implementations can be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A system for printing on media, the system having a plurality of system parameters and the system comprising:

a printing system assembly configured to vertically separate media from a stack of media with in a printer input during a separation time and then deliver it to a printer marking engine; and a controller configured to measure the separation time, and wherein the controller is further configured to adjust a plurality of parameter settings according to the measured separation time and according to the influence each of the parameter settings has on the separation time.

2. The system of claim 1, further comprising:

a memory configured to hold the plurality of parameter settings; and wherein the memory includes initial parameter settings that correspond with an optimum separation time for a particular selected media type.

3. The system of claim 2, wherein the controller receives the measured separation time and compares the measured separation time to the optimum separation time and adjusts the parameter settings based on the difference between the optimum and measured separation times.

4. The system of claim 3, wherein the memory further holds a parameter range for each of the plurality of system parameters, wherein each of the initial parameter settings are set within a corresponding parameter range and wherein each of the parameter settings are adjusted within the corresponding parameter range.

5. A system for printing on media, the system having a plurality of system parameters and the system comprising:

a printing system assembly configured to separate media within a printer input during a separation time and then deliver it to a printer marking engine; and a controller configured to measure the separation time, and wherein the controller is further configured to adjust a plurality of parameter settings according to the measured separation time and according to the influence each of the parameter settings has on the separation time;

,wherein each parameter range further includes first and second sub-ranges and wherein each of the initial parameter settings are within the first sub-range of the corresponding parameter range.

6. The system of claim 5, wherein each parameter setting is first adjusted within its first sub-range before any parameter setting is adjusted within its second sub-range.

7. The system of claim 5, wherein each of the sub-ranges are further divided into predefined increments and wherein adjustments to parameter settings are made by adjusting the parameter settings one predefined increment at a time.

8. The system of claim 7, wherein the controller is further configured to monitor and store occurrences of a no-pick event and a multi-pick event such that upon the occurrence of either of these events the optimum separation time is adjusted and the parameter settings are adjusted by multiple increments at a time.

9. The system of claim 1, wherein the controller operates the printing system assembly to separate media, monitors the system parameters, and sets initial parameter settings that correspond with an optimum separation time for a particular selected media type based on the monitoring of the system parameters.

10. The system of claim 1, wherein the controller first preconditions the media before the controller measures the separation time and adjusts the parameter settings.

11. The system of claim 1, wherein the controller ignores a first sheet of media and thereafter measures the separation time in order to adjust the parameter settings.

12. A system for printing on media, the system having a plurality of system parameters and the system comprising:

a printing system assembly configured to separate media within a printer input during a separation time and then deliver it to a printer marking engine; and a controller configured to measure the separation time, and wherein the controller is further configured to adjust a plurality of parameter settings according to the measured separation time and according to the influence each of the parameter settings has on the separation time;

wherein the printing system assembly further includes first and second tractor rollers for engaging the media, a carriage mechanism for separating a top sheet of media, and a blower for blowing air into the media.

13. The system of claim 12, wherein the system parameters includes a down force parameter, which is the amount of force with which the first and second tractor rollers engage the media, a carriage angle parameter, which is the angle with which the carriage mechanism engages the media, and an air time parameter, which is the length of time air is blown into the stack of media.

14. A method of printing on media, the method comprising:

separating media from a printer input and delivering the media to a printer marking engine;

storing an optimum separation time corresponding to an optimum amount of time that it takes for a sheet of the media to be separated from a media stack in the printer input making it ready to be delivered to the printer marking engine;

measuring a separation time corresponding to the actual amount of time that it takes for a sheet of the media to be picked from the media stack in the printer input making it ready to be delivered to the printer marking engine;

storing a plurality of parameter settings for the media, each of which can influence the measured separation time;

comparing the optimum and measured separation times; and adjusting the parameter settings according to the comparison of the optimum and measured separation times and according to the influence each parameter setting has on the measured separation time.

15. The method of claim 14 further comprising defining and storing a parameter range for each of the corresponding parameter settings, wherein each of the parameter settings fall within the corresponding parameter range and wherein each of the parameter settings are adjusted within the corresponding parameter range.

16. A method of printing on media, the method comprising:

separating media from a printer input and delivering the media to a printer marking engine;

storing an optimum separation time corresponding to an optimum amount of time that it takes for a sheet of the media to be separated from the printer input making it ready to be delivered to the printer marking engine;

measuring a separation time corresponding to the actual amount of time that it takes for a sheet of the media to be picked from the printer input making it ready to be delivered to the printer marking engine;

storing a plurality of parameter settings for the media, each of which can influence the measured separation time;

comparing the optimum and measured separation times; adjusting the parameter settings according to the comparison of the optimum and measured separation times and according to the influence each parameter setting has on the measured separation time;

defining and storing a parameter range for each of the corresponding parameter settings, wherein each of the parameter settings fall within the corresponding parameter range and wherein each of the parameter settings are adjusted within the corresponding parameter range; and defining first and second sub-ranges within each parameter range, wherein each of the parameters' settings are initially set within the first sub-range of the corresponding parameter range.

17. The method of claim 16 further comprising first adjusting each parameter setting within its first sub-range before any parameter setting is adjusted within its second sub-range.

18. The method of claim 16 further comprising defining predefined increments within each of the sub-ranges, wherein adjustments to parameter settings are made by adjusting the parameter settings one predefined increment at a time.

19. The method of claim 18 further comprising monitoring and storing occurrences of a no-pick event and of a multi-pick event such that upon the occurrence of either of these events the optimum separation time is adjusted and the parameter settings are adjusted by multiple increments at a time.

20. The method of claim 14, further comprising monitoring system parameters as media is separated from the printer input making it ready to be delivered to the printer marking engine and setting and storing initial parameter settings that correspond with the optimum separation time for a particular selected media type based on the monitoring of the system parameters.

21. The method of claim 14, further comprising preconditioning the media before measuring the separation time and before adjusting the parameter settings.

22. The method of claim 14, further comprising measuring the separation time in order to adjust the parameter settings after a first sheet of media has been separated from a stack of media.

23. The method of claim 14, further comprising measuring curvature of the media in the printer input and adjusting the optimum separation time based on the measured curvature.

24. A system for printing on media, the system comprising:

a feedhead assembly configured to pick media from a stack media in a printer input during a separation time and deliver it to a printer marking engine under the influence of first and second system parameters;

memory communicating with the feedhead assembly and configured to hold first and second initial parameter settings and associated optimum separation times; and means in communication with the feedhead assembly and the memory for measuring a measured separation time and for adjusting at least one of the first and second parameter settings according to a comparison between the optimum and measured separation times and according to an influence that the first and second parameter setting have on the measured separation time.

25. A system for printing on media, the system comprising:

a feedhead assembly configured to pick media from a printer input and deliver it to a printer marking engine under the influence of first and second system parameters;

memory communicating with the feedhead assembly and configured to hold first and second initial parameter settings and associated optimum separation times;

means in communication with the feedhead assembly and the memory for measuring a measured separation time and for adjusting at least one of the first and second parameter settings according to a comparison between the optimum and measured separation times and according to an influence that the first and second parameter setting have on the measured separation time; and an input feeder configured to hold a stack of media, first and second tractor rollers coupled to the feedhead assembly that engage the media, a carriage mechanism for separating a sheet of media from the stack of media, and a blower for blowing air into the stack of media.

26. The system of claim 25, wherein the first parameter setting is a down force setting and the first system parameter is a down force parameter, which is the amount of force with which the first and second tractor rollers engage the media, wherein the second parameter setting is a carriage angle setting and the second system parameter is a carriage angle parameter, which is the angle with which the carriage mechanism engages the media.

27. The system of claim 26, further comprising a third parameter setting, which is an air time setting, and further comprising a third system parameter, which is an air time parameter and is the length of time the air is blown into the stack of media.

28. The system of claim 27, wherein the down force parameter, carriage angle parameter, and air time parameter are each adjustable and wherein such adjustments can affect the measured separation time.

29. The system of claim 27, wherein the memory further holds a down force parameter range for the down force parameter, a carriage angle parameter range for the carriage angle parameter, and an air time parameter range for the air time parameter, and wherein adjustments to the down force, carriage angle, and air time parameter settings are made within the corresponding down force, carriage angle, and air time parameter ranges.

30. The system of claim 29, wherein the down force, carriage angle, and air time parameter ranges each further include first, second and third sub-ranges.

31. The system of claim 30, wherein the down force parameter has an initial down force setting in its first sub-range, wherein the carriage angle parameter has an initial carriage angle setting in its first sub-range, and wherein the air time parameter has an initial air time setting in its first sub-range.

32. The system of claim 31, wherein each the down force, carriage angle, and air time initial parameter settings are first adjusted within the corresponding first sub-range before any of the down force, carriage angle, and air time parameter settings are adjusted within the corresponding second sub-range.

33. The system of claim 30, wherein each of the sub-ranges are further divided into predefined increments and wherein adjustments to parameter settings are made by adjusting the parameter settings one predefined increment at a time.

34. The system of claim 33, further comprising means for monitoring and storing occurrences of a no-pick event and a multi-pick event such that upon the occurrence of either of these events the optimum separation time is adjusted and the parameter settings are adjusted by multiple increments at a time.

35. The system of claim 24, wherein the memory further holds a first parameter range for the first system parameter and a second parameter range for the second system parameter, and wherein adjustments to the first and second system parameter settings are made within the corresponding first and second parameter ranges.

36. The system of claim 35, wherein the first and second parameter ranges each further include first and second sub-ranges.

37. The system of claim 36, wherein each the first and second system parameter settings are first adjusted within the corresponding first sub-range before either the first and second system parameter settings are adjusted within the corresponding second sub-range.

* * * * *

UNITED STATES PATENT AND TRADEMARK OFFICE

CERTIFICATE OF CORRECTION

PATENT NO. : 7,413,182 B2
APPLICATION NO. : 11/072126
DATED : August 19, 2008
INVENTOR(S) : Wade A. Powell et al.

It is certified that error appears in the above-identified patent and that said Letters Patent is hereby corrected as shown below:

In column 12, line 43, in Claim 1, delete “with in” and insert -- within --, therefor.

In column 13, line 11, in Claim 5, delete “,” before “wherein”.

In column 15, line 13, in Claim 24, insert -- of -- before “media”.

Signed and Sealed this

Eleventh Day of November, 2008

JON W. DUDAS
*Director of the United States Patent and Trademark Office*